US005495684A

United States Patent [19]

Herber

[11] Patent Number: 5,495,684

[45] Date of Patent: Mar. 5, 1996

[54] SHOE WITH ATTACHED LEGGING FOR USE IN A CLEAN ROOM

[75] Inventor: Karl-Heinz Herber, Sinntal-Mottgers, Germany

[73] Assignee: ALSA GmbH, Steinau-Uerzell, Germany

[21] Appl. No.: 204,562

[22] Filed: Mar. 1, 1994

[51] Int. Cl.[6] ..... A43B 1/02; A43B 3/16; A41D 17/00

[52] U.S. Cl. ..... 36/84; 36/2 R; 36/7.1 R

[58] Field of Search ..... 36/9 R, 99, 100, 36/101, 18, 19, 17, 58.5, 7.1 R, 55, 2 R, 2 A, 2 B, 84

[56] References Cited

U.S. PATENT DOCUMENTS

| | | | |
|---|---|---|---|
| 1,093,032 | 4/1914 | Cadenas | 36/9 R |
| 2,147,197 | 2/1939 | Glidden | 36/45 X |
| 2,236,367 | 3/1941 | Gruber | 36/101 |
| 3,234,667 | 2/1966 | Bovay | 36/58.5 X |
| 3,235,981 | 2/1966 | Kloss | 36/58.5 |
| 3,345,762 | 10/1967 | Fisher et al. | 36/9 R |
| 4,300,294 | 11/1981 | Riecken | 36/101 X |
| 4,314,412 | 2/1982 | Anderson et al. | 36/100 |
| 4,689,900 | 9/1987 | Ishibashi | 36/7.1 R X |
| 4,858,340 | 8/1989 | Pasternak | 36/88 |
| 5,144,759 | 9/1992 | Mascotte | 36/71 R |

FOREIGN PATENT DOCUMENTS

| | | |
|---|---|---|
| 2128981 | 10/1972 | France . |
| 1685732 | 8/1971 | Germany . |
| 2341261 | 2/1975 | Germany . |
| 7633823 | 4/1977 | Germany . |

*Primary Examiner*—Paul T. Sewell
*Assistant Examiner*—BethAnne C. Dayoan
*Attorney, Agent, or Firm*—Evenson, McKeown, Edwards & Lenahan

[57] ABSTRACT

A clean air shoe having a shoe bottom adapted to the size of the foot, and with a peripheral seam edge whose upper end is sewn together with a legging by means of a seam. Below this seam there runs a second seam with which an upper is connected to the seam edge. In this manner a normal shoe, which is connected to a legging, is produced.

7 Claims, 1 Drawing Sheet

SHOE WITH ATTACHED LEGGING FOR USE IN A CLEAN ROOM

BACKGROUND OF THE INVENTION

The invention relates to a clean air shoe comprising an antistatic shoe bottom, which has a peripheral seam edge, which is pulled up and to which a legging is connected by means of a seam.

Clean air shoes of the aforementioned kind have to be made in such a manner that they can be sterilized at temperatures of about 180° C. They are designed as overshoes and are worn over one's own shoes during work in clean air areas and cover with their respective legging the upper region of a pant leg. Usually such clean air shoes are made in only two sizes that fit together. Since they are overshoes, they are quite large, look clumsy and walking in them is difficult. In addition, heat accumulates, since the overshoe is worn on the normal footwear.

SUMMARY OF THE INVENTION

The invention is based on the problem of designing a clean air shoe of the aforementioned kind in such a manner that the result is maximum wearing comfort without impairing its function as a clean air shoe.

This problem is solved according to the invention in that the shoe bottom is adapted to the size of the foot and below the seam of the legging an upper is connected to the edge of the seam of the shoe bottom.

Such a clean air shoe is not an overshoe, rather it is worn as a normal shoe. Therefore, it also offers the wearing comfort of a conventional shoe, Since the edge of the seam is designed in order to connect to the upper and the legging, the clean air shoe according to the invention can be manufactured very inexpensively. At the same time it has the durability of a conventional shoe.

To ventilate the foot and thus the wearing comfort it is especially advantageous If the shoe bottom forms, with the upper, a sandal. There are no drawbacks with this design, because the foot is totally covered by means of the legging.

The strapping forming the upper does not protrude in the shoe, so that it cannot pinch if, according to another embodiment of the invention, recesses which lead from the top into the edge of the seam and are intended for receiving a strapping forming the upper are provided on the inside in the edge of the seam.

Even a protrusion of the seam connecting the strapping to the edge of the seam can be avoided in a simple manner by providing a seam groove on the outside and inside in the edge of the seam so as to be in alignment in order to attach the upper.

The legging can be attached to the edge of the seam with the customary machine if the legging is sewn by means of a binding, which reaches in the shape of a U over the upper edge of the seam edge, between the outer section of this binding and the seam edge.

To further heighten the wearing comfort it is expedient, if the shoe bottom has an orthopedic sole and is provided with an insole.

As an alternative it is possible for the shoe bottom to have a flat surface and to put an insole with orthopedic sole on the flat surface.

BRIEF DESCRIPTION OF THE DRAWING

The invention allows various embodiments. To further elucidate the basic principle, one embodiment is shown in the drawing wherein.

DESCRIPTION OF THE PREFERRED EMBODIMENT

Figure 1:
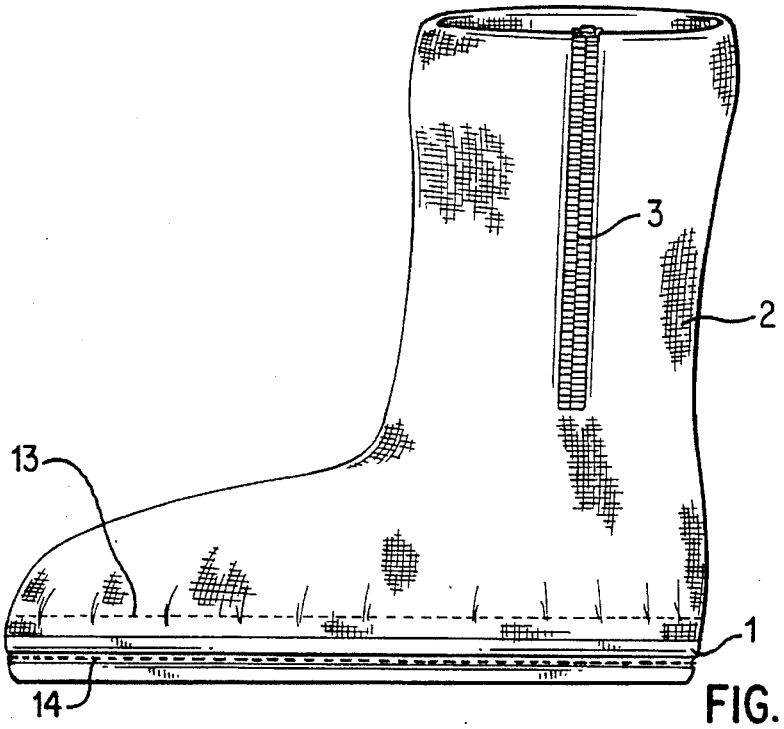
FIG. 1 is a schematic side elevational view of the clean air shoe according to the invention.

FIG. 1 depicts the clean air shoe in its entirety, of which a shoe bottom 1, made of polyurethane, for example, and a legging 2 made of a thin, very flexible material can be seen. This legging 2 can have a zipper 3 extending in the longitudinal direction, so that it can be pulled with greater ease over the bottom end of a pant leg while putting on the clean air shoe.

Figure 2:
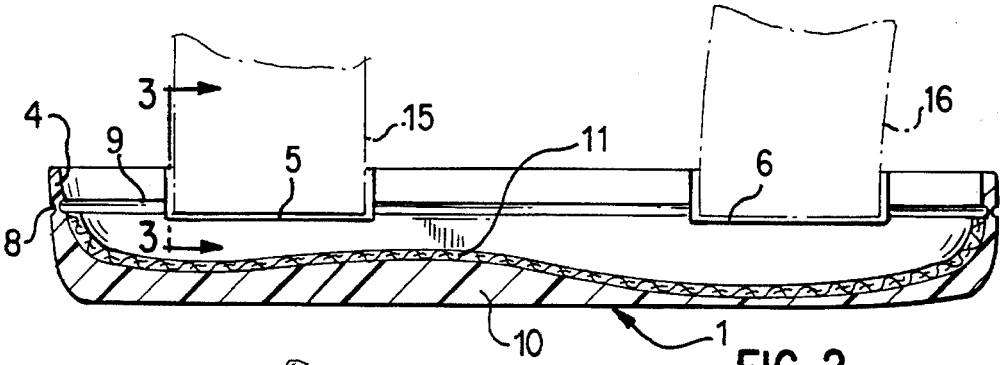
FIG. 2 is a longitudinal sectional view of a shoe bottom of the clean air shoe.

The sectional view according to FIG. 2 shows that the shoe bottom 1 has a peripheral seam edge 4, which is pulled up and into which, on the inside, recesses 5, 6 lead from the top. In the finished shoe a strapping, which forms an upper 7 shown partially in FIG. 3, runs into these recesses. One can also see in FIG. 2 on the outside and inside at the seam edge 4 a seam groove 8, 9 and an orthopedic sole 10 of the shoe bottom, which is covered toward the top by means of an insole 11. In another embodiment, the shoe bottom 1 and the upper in the form of straps 15, 16 can form a sandal.

Figure 3:
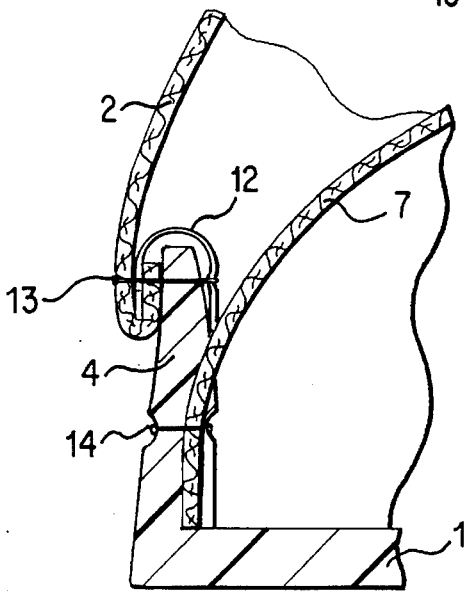
FIG. 3 is a transverse sectional view taken along the line 3—3 of the connecting region of the shoe bottom with its upper and its legging.

FIG. 3 shows how the legging 2 is connected with a seam 13 to the shoe bottom 1 by means of a U-shaped binding 12, which reaches over the upper edge of the seam edge 4. The upper 7 is attached to the seam edge 4 by means of a seam 14 below the seam 13.

I claim:

1. A shoe for use in a clean room comprising an antistatic shoe bottom which comprises an upwardly extending peripheral seam edge containing a seam; a legging connected to said seam, wherein the shoe bottom is adapted to the size of the foot; and an upper connected to the seam edge below said seam, to the upwardly extending peripheral seam edge wherein the legging is sewn with a binding which reaches in the shape of a U over the upper edge of the upwardly extending seam edge between an outer section of the binding and an inner face of the seam edge.

2. A shoe for use in a clean room as claimed in claim 1, wherein the shoe bottom and the upper together form a sandal.

3. A shoe for use in a clean room comprising an antistatic shoe bottom which comprises an upwardly extending peripheral seam edge containing a seam; a legging connected to said seam, wherein the shoe bottom is adapted to the size of the foot; and an upper connected to the seam edge below said seam; wherein the shoe bottom and the upper together form a sandal; and recesses in the upwardly extending peripheral seam edge for receiving a strapping forming the upper which lead from the top of the shoe bottom into an edge of the seam inside the shoe in the seam edge.

4. A shoe for use in a clean room as claimed in claim 3, wherein the shoe bottom has an orthopedic sole and is provided with an insole.

5. A shoe for use in a clean room as claimed in claim 4, wherein the shoe bottom has a flat surface, said orthopedic sole is put on said flat surface, and said insole is placed over said orthopedic sole.

6. A shoe for use in a clean room comprising an antistatic shoe bottom which comprises an upwardly extending peripheral seam edge containing a seam; a legging connected to said seam, wherein the shoe bottom is adapted to the size of the foot; and an upper connected to the seam edge below said seam; and a seam groove in the upwardly extending peripheral seam edge to which the upper is attached outside of the shoe bottom and inside of the upwardly extending peripheral seam edge.

7. A shoe for use in a clean room as claimed in claim 6, wherein the shoe bottom and the upper together form a sandal.

* * * * *